US006591501B1

(12) United States Patent
Phillips

(10) Patent No.: US 6,591,501 B1
(45) Date of Patent: Jul. 15, 2003

(54) UTILITY KNIFE

(76) Inventor: Kenneth Gary Phillips, 6045 N. Armstrong, Wichita, KS (US) 67204

( * ) Notice: Subject to any disclaimer, the term of this patent is extended or adjusted under 35 U.S.C. 154(b) by 1 day.

(21) Appl. No.: 09/627,574

(22) Filed: Jul. 28, 2000

(51) Int. Cl.[7] ..... B26B 3/08
(52) U.S. Cl. ..... 30/2; 30/291; 30/294
(58) Field of Search ..... 30/294, 2, 291, 30/286

(56) References Cited

U.S. PATENT DOCUMENTS 1,328,547 A * 1/1920 Shaw ..... 30/291
1,795,527 A * 3/1931 Tyreman ..... 30/2
2,582,677 A * 1/1952 Burnett ..... 30/291
2,601,414 A * 6/1952 Mittelstaedt ..... 30/2
2,681,502 A * 6/1954 Black ..... 30/286
2,686,360 A * 8/1954 Fisher ..... 30/286
2,686,969 A * 8/1954 Furey ..... 30/2
2,889,623 A * 6/1959 Baker ..... 30/2
3,613,134 A * 10/1971 Bassett ..... 30/2
4,291,461 A * 9/1981 Hansen ..... 30/286
4,514,902 A * 5/1985 Stewart ..... 30/2
5,122,152 A * 6/1992 Mull ..... 606/170
5,852,874 A * 12/1998 Walker ..... 30/2
5,878,498 A * 3/1999 Mundlt ..... 30/2

* cited by examiner

*Primary Examiner*—Kenneth E. Peterson
*Assistant Examiner*—Omar Flores-Sánchez
(74) *Attorney, Agent, or Firm*—Kenneth H. Jack; Davis & Jack, L.L.C.

(57) ABSTRACT

A utility knife comprising a bar having a forward end, a rearward end, an upper side, and a lower side; a blade having a cutting edge; screw clamps for removably mounting the blade upon the forward end of the bar; a pull handle extending upwardly and forwardly from the rearward end of the bar; a cutting edge guard pivotally mounted upon the bar; and a blade shroud fixedly mounted upon the bar.

3 Claims, 5 Drawing Sheets

UTILITY KNIFE

FIELD OF THE INVENTION

This invention relates to knives. More particularly, this invention relates to utility knives adapted for facilitating a pulling cutting action.

BACKGROUND OF THE INVENTION

Utility knives adapted for a rearward cutting action, such as cardboard box cutters are known. However, such knives are typically cumbersome and unwieldy, having a handle structure which fails to ergonomically facilitate a rearward cutting action. Further, such utility knives typically provide no feature or structure facilitating quick and convenient storage upon and accessibility from work belts, belt loops, and the like. The instant inventive utility knife addresses and solves such deficiencies by providing an economically constructed and mechanically simple utility knife having a handle structure which ergonomically facilitate a rearward cutting action. Safety and storage features enhance the usefulness of the knife. Such objects are achieved through configuration of a metal bar to dually function as a blade mount and a back pulling handle.

BRIEF SUMMARY OF THE INVENTION

The instant inventive utility knife preferably comprises a ⅜" steel bar bent in the form of a "V". The distal end of a first leg of the "V" bar preferably functions as a blade mount, while the second leg functions as a back pulling handle. Where the blade mounting leg of the "V" bar is held in a horizontal orientation, with blade downwardly extended, it is preferable that the back pulling handle leg of the "V" bar extend upwardly at a forwardly tilting acute angle. The forward tilt of the pull handle leg of the "V" bar ergonomically matches the progressive forward tilt of an operator's index, middle, third, and fourth fingers while grasping such pull handle.

In order to facilitate additional hand control of the knife, it is preferable that the cross-sectional profile of the back pulling handle be expanded for prevention of rotation within an operator's hands. Suitably, such expansion may be accomplished by molding around the back pulling handle leg a plastic casing similar to that of a common plastic screwdriver handle. Preferably, such handle expansion is accomplished by configuring the back pulling handle leg of the "V" bar to further extend along its length, following a rearward 180° bend. Such rearward bend and extension of the pull handle leg of the "V" bar beneficially forms an inverted "U" slot for convenient storage upon and retrieval from an operator's belt loop, while providing for enhanced hand control. An operator's hand gripping across the "U" prevents the knife from undesirably rotating within the hand.

Preferably, a common reversible trapezoidal utility knife blade is fixedly and removably mounted upon the distal end of the blade mounting leg of the "V" bar. For efficient back pulling cutting of materials such as cardboard, the cutting edge of such trapezoidal blade may be milled to form a rearwardly facing cutting hook. A preferred mounting means for such blade comprises screws threadedly mounted within such leg of the "V" bar, the heads of such screws compressively holding the blade against such bar.

For enhancement of the safety of such reversible trapezoidal blade, it is preferable that a cutting edge guard be mounted upon the blade mounting leg of the "V" bar for pivotal motion between a first position, wherein such guard underlies and protects the cutting edge, and a second position, wherein the cutting edge guard extends rearwardly, clearing the blade for use. Also, for enhancement of safety, it is preferable that a blade shroud be fixedly and removably attached to the blade mounting leg of the "V" bar, such shroud overlying the upper end of the trapezoidal blade.

In use, the cutting edge guard of the inventive utility knife may be pivotally moved rearwardly to its second position while the handle of the knife is securely grasped in a user's hand. The blade is then driven downwardly into and through material to be cut. Thereafter, the knife is pulled rearwardly, driving the cutting edge of the blade against the material, slicing the material. When the inventive utility knife is not in use, the cutting edge guard may be pivotally moved forwardly to its first position so that it underlies and guards the cutting edge of the blade. Thereafter, the preferred inverted "U" shaped handle may be conveniently extended or hooked through a belt loop for convenient storage and quick retrieval.

Accordingly, it is an object of the present invention to provide a utility knife which is economically and simply constructed.

It is a further object of the present invention to provide such a knife capable of ergonomically facilitating a back pulling cutting action.

It is a further object of the present invention to provide such a knife which is safe to use and store, and which is easily and conveniently storable and accessible.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 1:
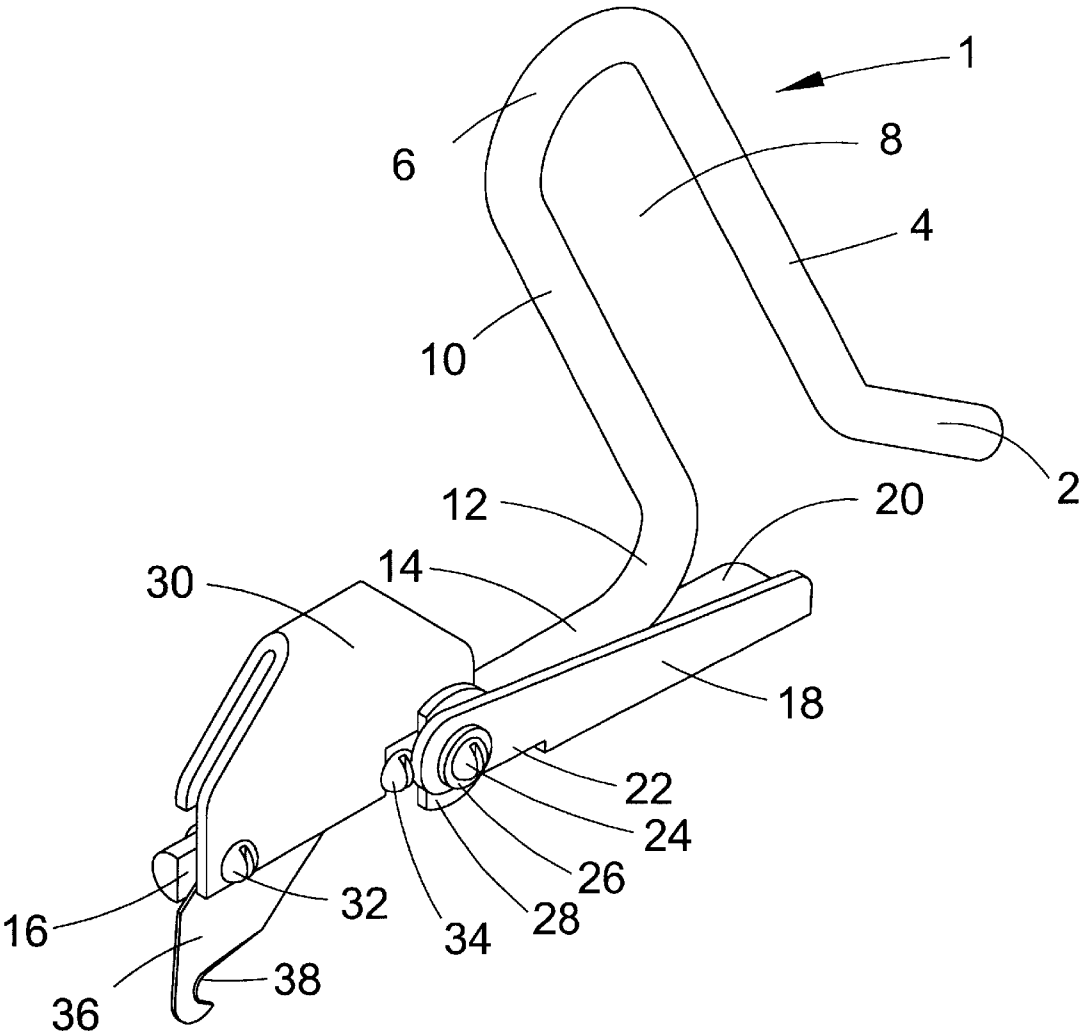
FIG. 1 is an isometric view of a preferred embodiment of the inventive utility knife, such view showing an in use configuration.

Referring now to the drawings, and in particular to FIG. 1. The present inventive utility knife is referred to generally by reference arrow 1. A major structural element of utility knife 1 comprises a bar or leg 14 having a forward end, and a rearward end, the rearward end of the bar 14 preferably extending rearwardly into an upturned bend 12. The section of such bar which extends upwardly from upturned bend 12 forms a pull handle 10, the forward facing surface of the pull handle 10 providing a finger engaging surface for back pulling, cutting action.

Figure 2:
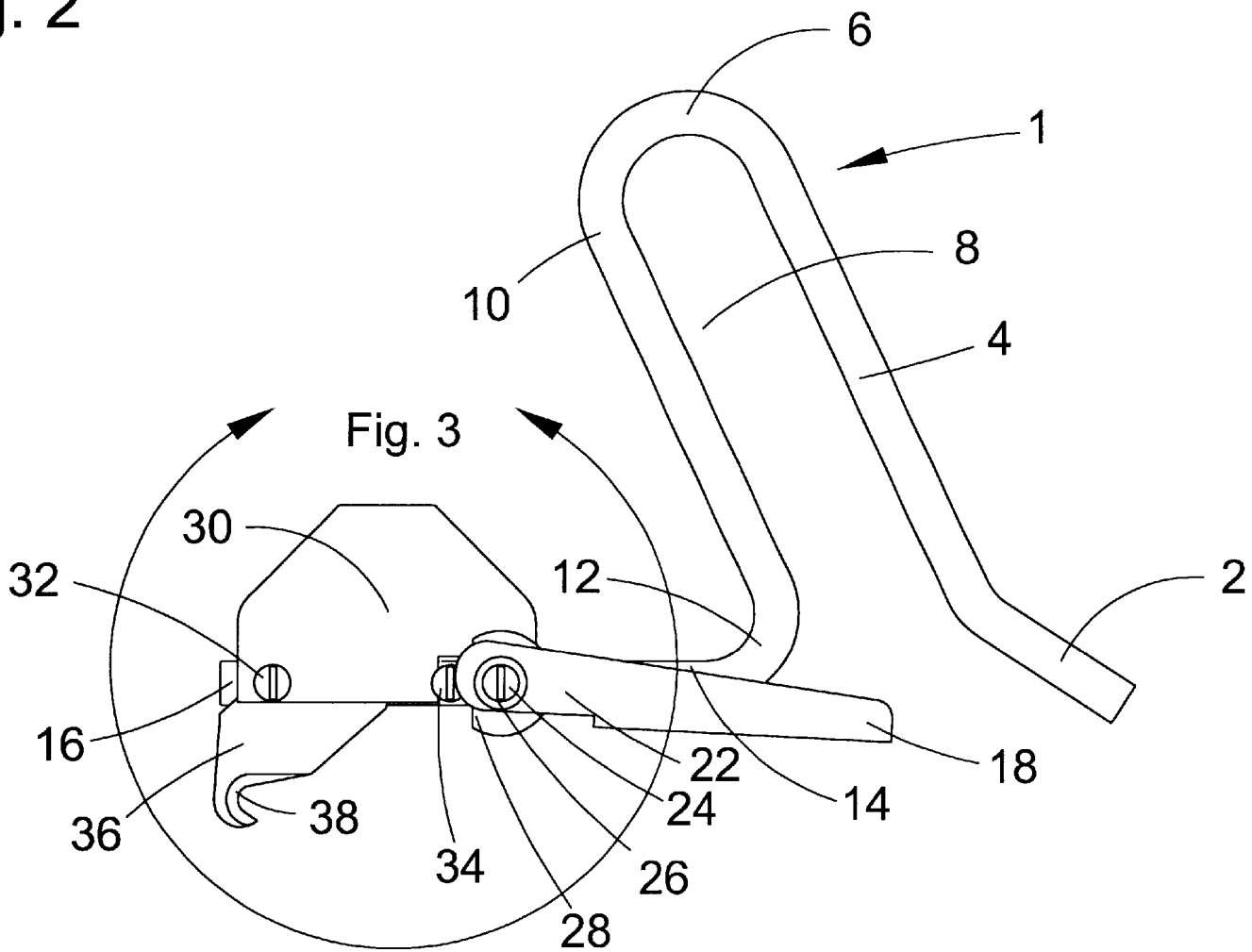
FIG. 2 is a side view of the utility knife depicted in FIG. 1.

Referring simultaneously to FIGS. 1 and 2, it is preferable that bar 14, bend 12, and pull handle 10, in combination, form a "V" bar configuration wherein the angle between bar 14 and pull handle 10 is acute or less than 90°. The human hand will not ergonomically grasp and pull an object such as a bar which lies across the palm of the hand perpendicular to the wrist and forearm. The natural extensions of the index, middle, third and fourth fingers of a hand grasping such a bar establishes a grasping angle, deviating from perpendicular, wherein the index finger extends further from the wrist than the fourth finger. In order to ergonomically match such grasping angle, it is preferable that the pull handle 10 simultaneously extend upwardly and forwardly with respect to bar 14.

Referring again to FIG. 1, where a handle is configured as a narrow bar such as the depiction of pull handle 10, such pull handle may tend to undesirably rotate axially within a user's hand. In order to resist such undesirable rotation, the cross-sectional profile of the pull handle 10 may suitably be enlarged. A suitable means of enlarging the cross-sectional profile of pull handle 10 is to mold therearound a ridged barrel shaped plastic member (not depicted), such as is common to plastic screwdriver handles. The preferred means of resisting such undesirable rotating motion is to form the distal end of pull handle 10 to further extend in a rearward 180° bend 6, and thence further extend rearwardly forming a palm engaging member 4, such member having a rearwardly facing palm engaging surface. The combination of the pull handle 10, bend 6, and palm engaging member 4 conveniently allows a user of the knife 1 to grasp the pull handle 10, applying pressure to its forwardly facing finger engaging surface and driving the palm engaging surface of palm engaging member 4 against the palm of the user's hand. Such counter-pressure between the fingers and palm of a user's hand efficiently prevents the knife 1 from undesirably rotating axially about the pull handle within the user's hand.

Referring further to FIG. 1, the pull handle 10, bend 6, and palm engaging member 4 in combination preferably form an inverted "U" having a belt loop slot 8 situated between the palm engaging and finger engaging surfaces. Where it is desirable that the inventive knife 1 be conveniently stored for ready access, bar end 2 may be extended through a common belt loop or work belt implement loop, allowing slot 8 to serve as a knife retaining hook.

Figure 3:
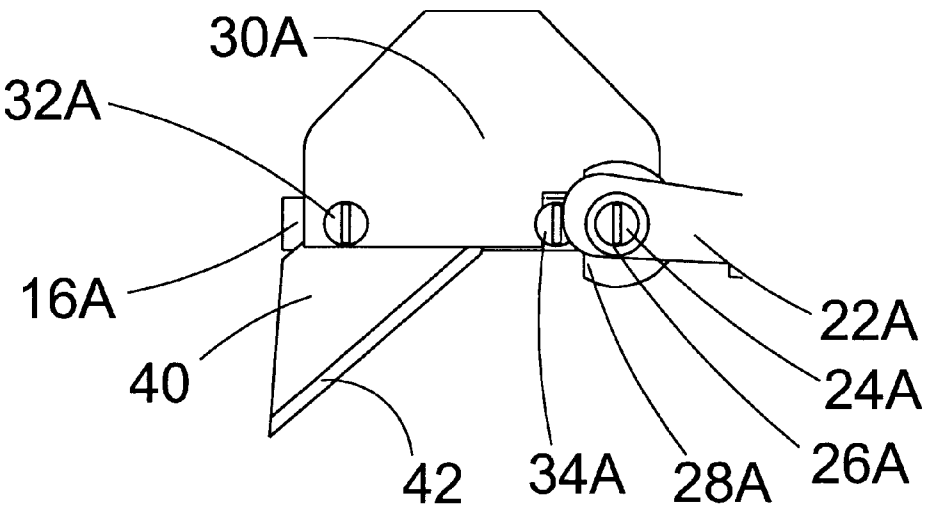
FIG. 3 is a partial view of the utility knife depicted in FIG. 2, such partial view showing an alternate blade configuration.
Figure 5:
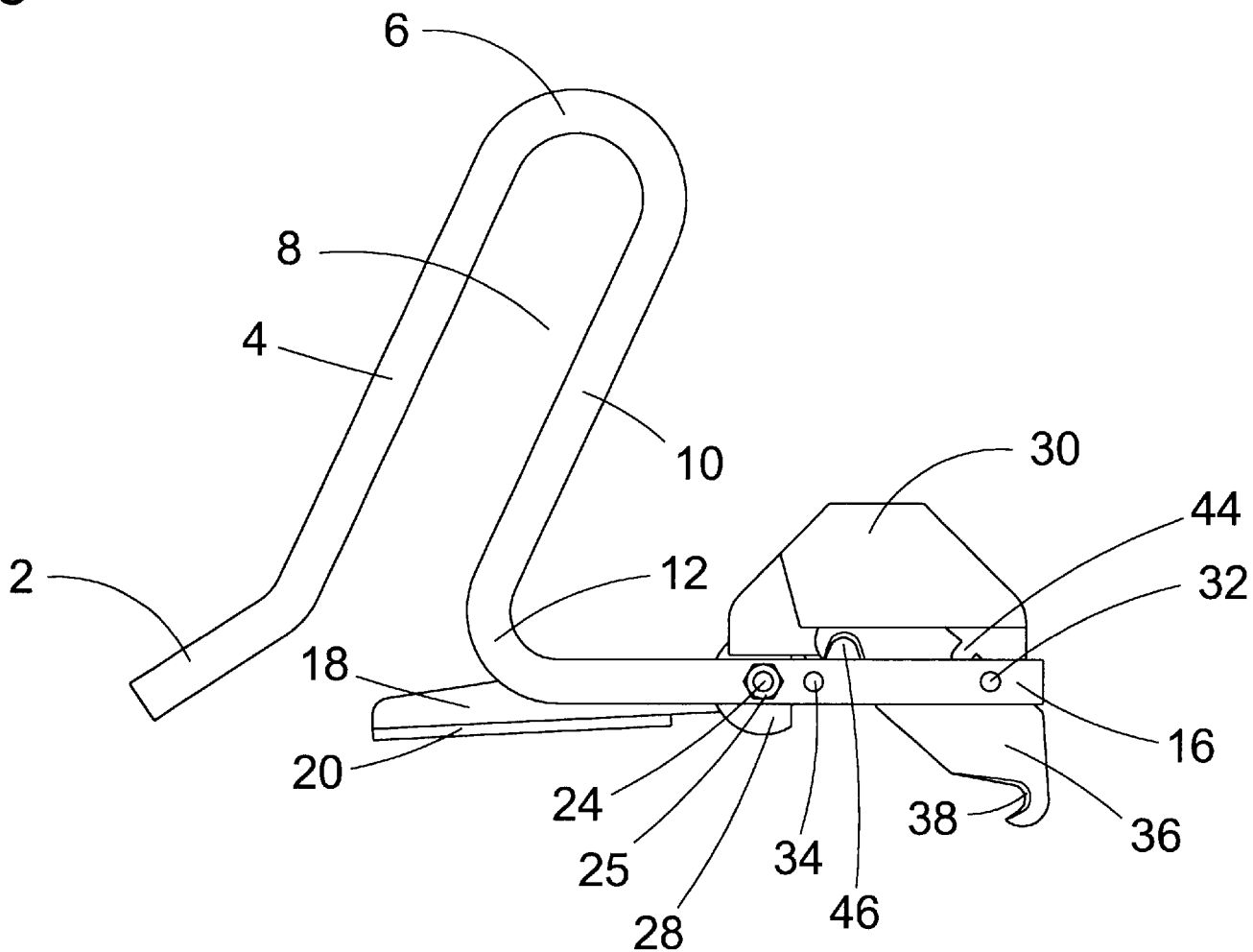
FIG. 5 is a reverse side view of the utility knife depicted in FIG. 2.

Referring simultaneously to FIGS. 2 and 5, a common reversible trapezoidal utility knife blade is preferably fixedly and removably attached to the forward or distal end of the blade mounting leg 14. Preferably, the cutting edge 38 of the trapezoidal blade 36 is milled to form a rearwardly facing hook for efficient back pulling cutting of materials such as cardboard. Alternately, referring to FIG. 3, all reference numerals having the suffix "A" are substantially identical to similarly numbered elements appearing in FIG. 2. FIG. 3 depicts a suitable alternate trapezoidal utility knife blade 40 having a straight downwardly extending and rearwardly facing cutting edge 42.

Referring simultaneously to FIGS. 2 and 5, in order to facilitate mounting of blade 36, it is preferable that the distal end of blade mounting leg 14 be milled to present a flat leftwardly facing (or suitably rightwardly facing) inset face 16, such face allowing the right face of blade 36 to be abuttingly mounted thereon. Preferably, blade and shroud mounting screws 32 and 34 are threadedly mounted within the distal end of leg 14 so that they extend perpendicularly from face 16. The blade and shroud mounting screws 32 and 34 simultaneously support blade shroud 30 while compressively driving the rightward facing. wall of such blade shroud against the leftward facing wall of blade 36; such compressive force in turn driving the right face of blade 36 against face 16. Such sequence of compressive forces effectively clamps the blade 36 between the rightwardly facing wall of blade shroud 30 and the leftwardly facing wall 16 of the distal end of leg 14.

Referring to FIG. 5, it is preferable that the upper edge of blade 36 have paired notches 44 situated equidistantly on either side on the vertical mid-line of the blade; and it is preferable that shroud and blade mounting screw 32 extend through the forwardmost notch 44. By extending the shroud and blade mounting screw 32 through notch 44, such screw is allowed to serve dual functions of a blade clamp and a blade slide stop.

Referring simultaneously to FIGS. 1 and 2, it can be seen that milling the distal end of leg 14 to create inset face 16 creates a forwardly oriented face which perpendicular to face 16. Such perpendicular face preferably is situated along the length of leg 14 to serve as a blade rotation stop.

Numerous other blade mounting means may be suitably (though less desirably) utilized for mounting a back cutting blade upon the forward or distal end of leg 14. For example, a simple slot (not depicted) may be cut extending axially through the forward or distal end of such leg, and a blade may be removably mounted within such slot by means of laterally extending shear pins, rivets, cotter pins, or threaded screws (all not depicted). Another suitable, though less desirable, blade mounting means comprises an internally spirally threaded blade mounting chuck (not depicted) which is common to craft knives or "XACTO" knives. Another suitable, though less desirable, blade mounting means incorporates a spring biased detent hinge (not depicted) typical in common folding pocket knives. All such suitable, though less desirable, blade mounting means are considered to fall within the scope of the invention.

Figure 4:
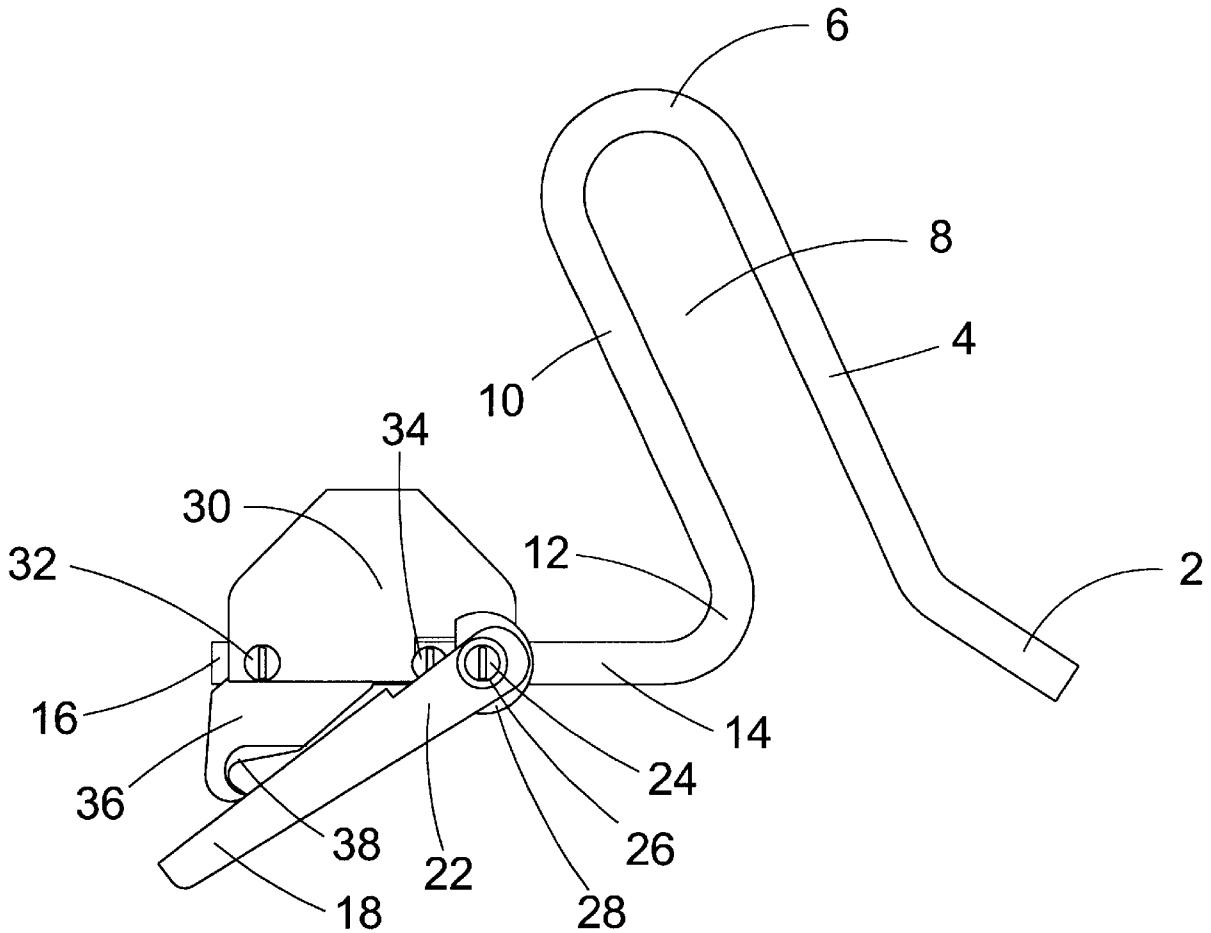
FIG. 4 is a side view of the inventive utility knife, such view showing a storage configuration.

Referring simultaneously to FIGS. 4 and 5, it is preferable that a cutting edge guard 18, having a laterally extending flange 20 and a longitudinally extending pivot eye 22, be pivotally mounted on "V" bar leg 14 so that it may pivot between first and second positions. Upon pivotal movement of cutting edge guard 18 to its first position depicted in FIG. 4, such guard 18 prevents objects such as fingers from coming into cutting contact with cutting edge 38. Where the cutting edge guard 18 is pivotally moved to its second position depicted in FIG. 5, it extends rearwardly, clearing the cutting edge 38 of blade 36 for rearward cutting action. Preferably, a screw 28 extending laterally through pivot eye 22 of cutting edge guard 18 and extending through a laterally extending aperture within bar 14, serves as a pivot axle. Preferably, screw 24 is secured in place by threaded nut 25, and preferably the screw 24 in combination with nut 25 compressively holds in sequence a steel washer 26 cutting edge guard pivot eye 22 and plastic washer 28 against the side wall of leg 14. Utilizing the preferred plastic washer 28 as opposed to a steel washer enhances frictional forces, assuring that the cutting edge guard 18 will remain in its selected open or closed position.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A utility knife comprising:

(a) a "V" bar having first and second legs, each leg having a proximal and a distal end, the second leg forming a pull handle, the second leg being acutely angled with respect to the first leg;

(b) a blade having a cutting edge;

(c) means for mounting the blade upon the distal end of the first leg of the "V" bar; the blade mounting means positioning the blade so that its cutting edge extends away from the second leg and faces the proximal end of the first leg;

(d) a cutting edge guard mounted upon the first leg of the "V" bar for pivotal motion between first and second positions, the cutting edge guard underlying the cutting edge of the blade while in the first position, the cutting edge guard extending toward the proximal end of the first leg while in the second position; and (e) a blade shroud fixedly attached to the first leg of "V" bar, the blade shroud overlying the blade; the blade being reversible.

2. The utility knife of claim 1 further comprising a palm engaging member fixedly attached to or homogeneously fused with the second leg of the "V" bar, the palm engaging member extending away from the first leg.

3. The utility knife of claim 2 wherein the second leg of the "V" bar, in combination with the palm engaging member, forms a belt loop slot.

* * * * *